United States Patent [19]

Qualls

[11] 4,389,699

[45] Jun. 21, 1983

[54] SWIVEL CELL LIGHT FIXTURE

[75] Inventor: Ned S. Qualls, Downingtown, Pa.

[73] Assignee: Armstrong World Industries, Inc., Lancaster, Pa.

[21] Appl. No.: 301,302

[22] Filed: Sep. 11, 1981

[51] Int. Cl.[3] ..... F21S 3/00

[52] U.S. Cl. ..... 362/217; 362/224; 362/239; 362/250; 362/252; 362/283; 362/297; 362/304; 362/427

[58] Field of Search ..... 362/217, 224, 239, 250, 362/252, 283, 297, 304, 427

[56] References Cited

U.S. PATENT DOCUMENTS 4,298,909 11/1981 Krieg ..... 362/346

4,302,800 11/1981 Pelletier ..... 362/250

*Primary Examiner*—Stephen J. Lechert, Jr.

[57] ABSTRACT

A light fixture is provided with a plurality of reflectors, each reflector is adjustable to a different position whereby the light fixture may provide plural paths of light. The light fixture has two end plates, a support bar, and a light tube. Individual adjustable reflectors are carried by the support bar and pass around the light tube. Depending upon the position of the reflector, the single light tube may provide lumination in a number of different areas.

2 Claims, 4 Drawing Figures

SWIVEL CELL LIGHT FIXTURE

BACKGROUND OF THE INVENTION

1. Field of the Invention

The invention is directed to a light fixture, and particularly to a light fixture which has a plurality of adjustable reflectors whereby the different reflectors may provide different paths of concentration of light from a single light tube.

2. Description of the Prior Art

U.S. Pat. No. 4,194,234 is directed to an electronic flash gun which has a number of reflectors. The reflectors are adjustable to provide plural paths of lumination.

SUMMARY OF THE INVENTION

The light fixture is composed of two end members which are spaced apart by a support bar. Positioned between the two end members is a fluorescent light tube. A plurality of adjustable reflectors are positioned around the fluorescent light tube. The reflectors are carried by the support bar and the reflectors have a plurality of positioning notches cut therein. Depending upon which notch is resting on the support bar will determine in which direction the open end of the reflector faces. Normally, approximately four notches are provided and, therefore, the reflector is capable of directing light in four different directions. Four or more reflectors are used, and thus the single light tube will be capable of directing a beam of light, due to the reflector construction, in at least four different directions.

Consequently, there is provided a single fluorescent tube light fixture which may be utilized to direct light on the top of a desk with a number of reflectors and then with other reflectors, direct a concentration of light to a table to the side of the desk or possibly to another table slightly spaced from the desk. For example, the light fixture could be used to provide illumination directly on a secretary's typewriter at the side of her desk, as well as to the center of her desk. The same light fixture could be used to provide light on both a desk and a table which are placed in a parallel relationship with the user's chair positioned between the table and the desk. Consequently, one now has a fluorescent lighting fixture that will not provide for overall lumination of an area, but variably controlled spot lumination to work areas.

DESCRIPTION OF THE PREFERRED EMBODIMENT

Figure 1:
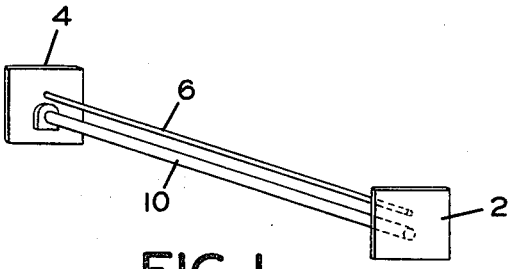
FIG. 1 is a perspective view of the light fixture without reflectors.

Referring now to FIG. 1, the basic light fixture structure is composed of two end plates 2 and 4 which are spaced apart from each other and held in position by a support bar 6. Positioned on the end plates 2 and 4 are conventional tombstone connectors 8 which are used to mount fluorescent light tubes in position. A fluorescent tube 10 is mounted on the two adjacent end plates and tombstones. The light fixture can be held in position by conventional means fastened to the end plates 2 and 4. In addition, by conventional means, electricity would be provided to the tombstones to operate the fluorescent tube.

Figure 4:
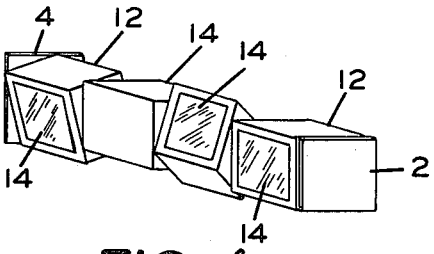
FIG. 4 is a perspective view of the assembled light fixture with reflectors in different positions.

Over the basic light fixture structure shown in FIG. 1 there would be positioned a plurality of reflectors, to be described later, which would then provide a total light fixture assembly as shown in FIG. 4. The end plates 2 and 4 are shown with the reflectors 12 positioned between the end plates. The reflectors are each provided with an open end 14 which may be faced in a number of different directions because of the construction of the reflectors to be described below. Consequently, as can be seen in FIG. 4, a single light fixture with a single light tube is capable of directing light in a number of different paths. The reflectors, because of the shape of their internal surfaces, their rotatability and their reflectivity, are able to direct the light from the single fluorescent tube into a number of different paths. The reflectors may be, and are preferably, made with a parabolic reflecting surface. However, the reflective surface need not be parabolic in shape. The showing in FIG. 4 is simply a preferred shape for the reflector and its reflective surface. The reflector could be made of a number of different shapes as, for example, that shown in U.S. Pat. No. 4,194,234.

Figure 2:
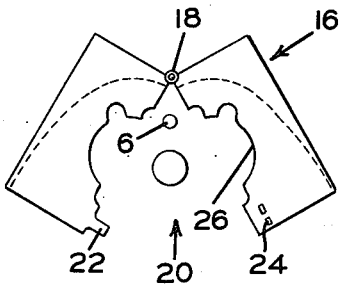
FIG. 2 is an end view of a reflector in its open position.
Figure 3:
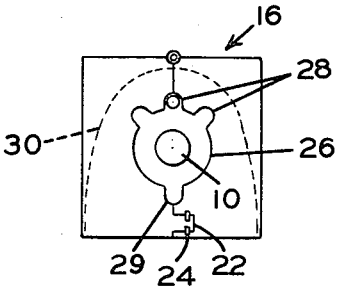
FIG. 3 is an end view of the reflector of FIG. 2 in its closed position over the support bar and light tube.

A typical reflector is shown in FIG. 2 in its open position and in FIG. 3 in its closed position around the support bar and the fluorescent tube. For ease of assembly, the reflector is made as a two-part structure which snaps over the fluorescent tube and the support bar of the light fixture. Naturally, it could be made as a one-part structure which would be slid on the end of the support bar and tube before one of the end plates is put into position. As shown in FIG. 2, the reflector 16 is composed of two parts. The two parts are hinged together at 18 and opened up at their end 20. When the two sections are fastened together a tab 22 engages slots 24 in a conventional manner to releasably hold the two sections together. Any conventional type of fastening means could be used to hold the two sections of the reflector together. The reflector is positioned around the support bar 6 and fluorescent tube 10. The reflector housing is provided with an aperture 26 in each of the two opposite sides thereof. The sides with the apertures are perpendicular to the open end 14 of the housing. The aperture 26 is best shown in FIG. 3 where the reflector is in its closed position. The size of the aperture is such that both the fluorescent tube and support bar will fit therein. The aperture is provided with a series of notches 28 and 29 positioned around the periphery of the aperture at different selected positions. The aperture 26 is of such a size that the reflector may be moved to a series of different positions with the support bar 6 in different notch locations. As shown in FIG. 3, the opened end or the aperture 14 may be positioned in a number of different locations. As shown, the aperture is facing downward. If the reflector is rotated 180° the support bar would then be located specifically in notch 29 and the aperture would be facing upward. If the support bar 6 is used in either one of the two notches on the opposite side of its location as shown in FIG. 3 the aperture 14 of the reflector would be facing either to the right or left of its current position and approximately at a 45° angle to the right or a 45° angle to the left of a vertical line through a reflector. Thus the structure shown in FIG. 3 is that for a reflector which is capable of being turned in four different positions. The support bar is really held in a set of notches. Two notches are in each set and there is one notch being used in each of the two opposite side walls. The dotted line 30 of FIG. 3 is a representation of the parabolic reflective surface which is used to direct the light in a definite path out of the aperture 14. Natually, the reflector housing could be of different shapes and the reflective surface could be of many different contours.

I claim:

1. A light fixture capable of directing light in several different directions, said light fixture comprising:

(a) a support structure for a single fluorescent tube, said support structure being (1) two end plates having positioned thereon means for receiving the ends of a fluorescent light tube, (2) a support bar positioned between said two end plates and rigidly holding the two end plates in position, (3) a single fluorescent light tube positioned between the two end plates in its tube end receiving means and in a parallel relationship with the support bar, (b) a plurality of individual adjustable reflectors for directing light from said single fluorescent light tube in a plurality of different directions, at least four or more reflectors being positioned around said single fluorescent light tube, each said reflector being:

(1) a housing having an open end, a reflective surface within said housing directing illumination from a source of illumination within the housing outwardly through the open end of the housing, (2) said housing having two opposite side walls each with an aperture therein, said support bar and said single fluorescent light tube passing through the apertures in each of the two side walls, said side wall apertures being such that they position the fluorescent tube in position to function as the source of illumination for providing light rays which the reflective surface will now direct outwardly from the open end of the housing, said apertures of the housing having a plurality of notches around the periphery thereof, said support bar being positioned in one set of notches and said housing being movable to position said support bar in different sets of notches around the periphery of the apertures so that the reflector housing will have its open end pointed in a plurality of different directions around a 360° arc.

2. A light fixture as set forth in claim 1 wherein said housing is made in two parts hinged together at one side and releaseably fastened together at its opposite side.

* * * * *